US005903925A

United States Patent [19]

Engebretson

[11] Patent Number: 5,903,925

[45] Date of Patent: May 18, 1999

[54] ORNAMENTAL HORNS AND THE LIKE WITH MECHANISM FOR SELECTIVE ATTACHMENT TO HEADGEAR

[76] Inventor: Lois E. Engebretson, 1590 N. Garfield Ave. Unit A, Louisville, Colo. 80027

[21] Appl. No.: 09/066,240

[22] Filed: Apr. 24, 1998

[51] Int. Cl.[6] ..... A42C 5/00

[52] U.S. Cl. ..... 2/209.13; 2/244

[58] Field of Search ..... 2/209.13, 175.3, 2/244; 40/329

[56] References Cited

U.S. PATENT DOCUMENTS 5,426,790 6/1995 Robertson ..... 2/209.13

5,530,970 7/1996 Knutson ..... 2/209.13

5,600,855 2/1997 Ramirez ..... 2/209.13

5,652,959 8/1997 Proctor ..... 40/329

5,734,993 4/1998 D'Oca ..... 2/209.13

*Primary Examiner*—Diana L. Biefeld

*Attorney, Agent, or Firm*—Duft, Graziano & Forest, P.C.

[57] ABSTRACT

A pair of ornamental horns representing a team mascot are secured to a baseball cap or other wearable base supporting structure through the use of a spring fastener permitting selective attachment and detachment of the horns.

1 Claim, 2 Drawing Sheets

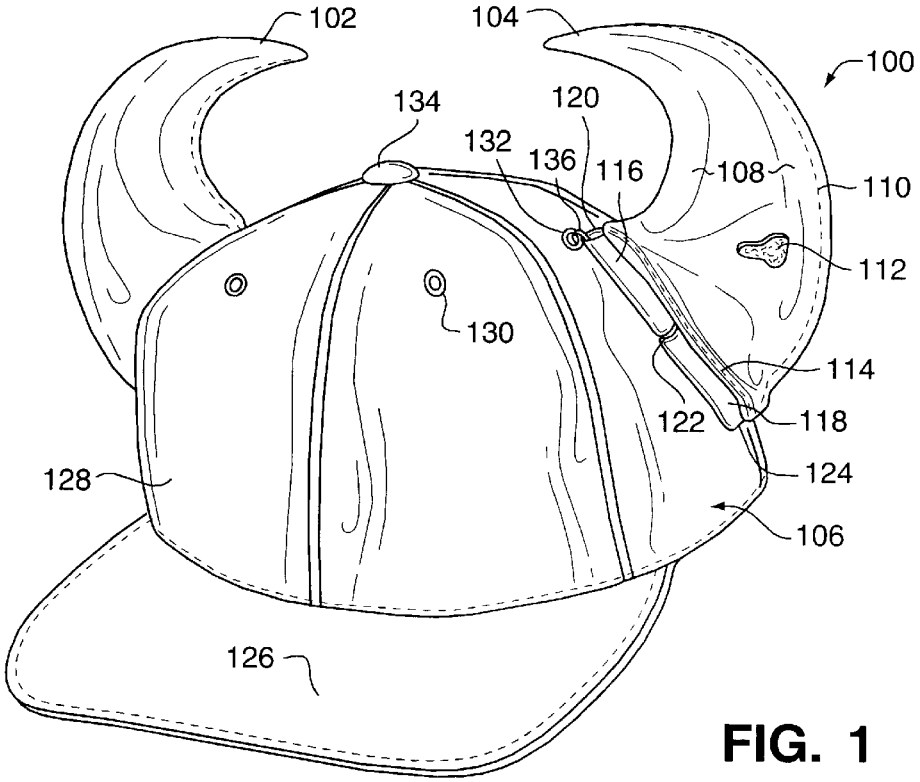
FIG. 1
FIG. 2
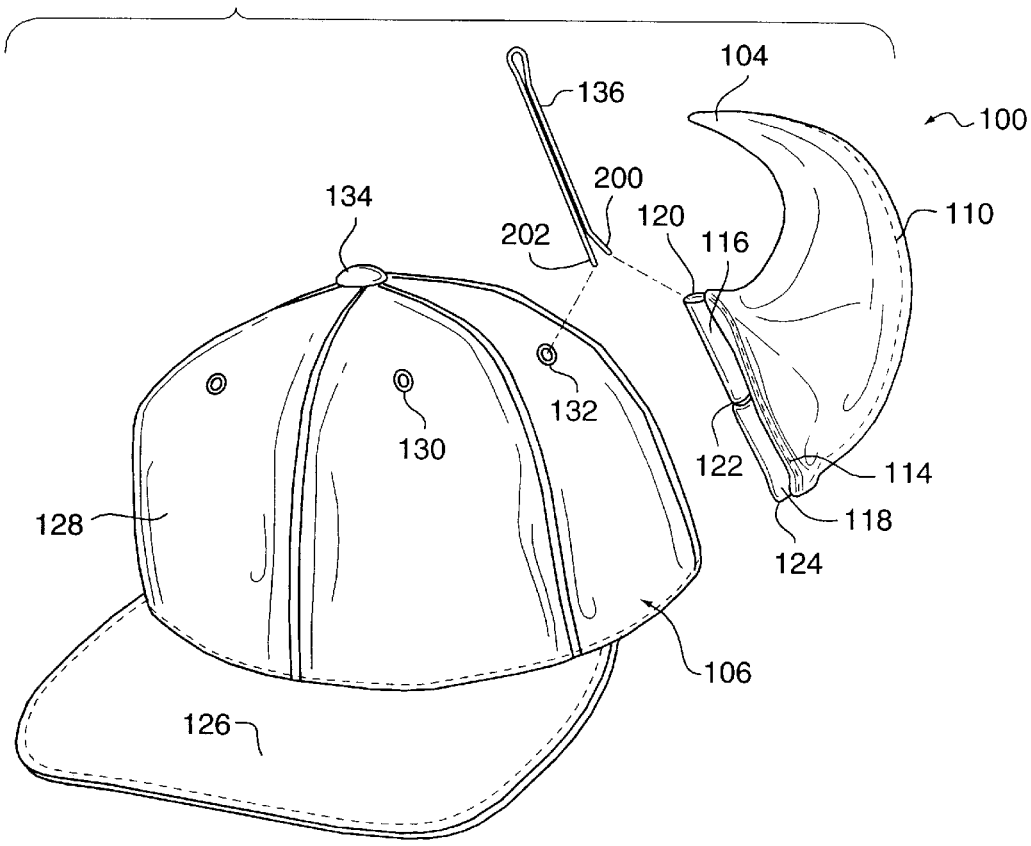

ORNAMENTAL HORNS AND THE LIKE WITH MECHANISM FOR SELECTIVE ATTACHMENT TO HEADGEAR

BACKGROUND OF THE INVENTION

1. Field of the Invention

The present invention pertains to the field of fanciful ornamental headgear of the type that people wear to identify themselves as being affiliated with a particular sports team or other organization. More specifically, the ornamental headgear includes facsimile animal horns or other fanciful objects that express affiliation with a sports team or other organization.

2. Statement of the Problem

Professional and collegiate sports fans are increasingly eager to add to the raucous spectacle of a sports event by wearing outlandish headgear. By way of example, a recent football game—the 1998 Superbowl between the Denver Broncos and the Green Bay Packers—included numerous instances where fans of the Packers wore large pieces of cheese on their heads. The cheese was real cheese in some cases. In other cases, the cheese was made of fabric stuffed with batting and designed to imitate the appearance of real cheese. These fans wore the cheese to make a public demonstration of their support for their team and to demonstrate their affiliation with a region of the country where cheese is made and from which the Packers find their base of support. Other instances of headgear worn to professional football events include instances where people wear crazy and illogical things on their head , e.g., a watermelon, with no demonstration of team affiliation. Fans of the New Orleans Saints have been known to wear bags over their heads.

Ornamental headgear design for sporting purposes is a stylish and trendy matter. The headgear is typically made of an integral construction that does not permit selective removal of the stylish and trendy ornamental features. This type of headgear rapidly fades into obsolescence with other trendy clothing and costume designs. An ornamental design that is in style this year for university or professional team affiliation may not be in style next year. Furthermore, a person may desire to have multiple pieces of headgear to accommodate different environments of use, e.g., an outdoor university football game in the rain versus an indoor university basketball game. The headgear can be fairly expensive, and many fans are only able to justify the purchase of one piece of headgear that is less than optimal for all environments.

SOLUTION

The present invention overcomes the problems that are outlined above by providing a mechanism permitting the selective attachment and detachment of ornamental headgear to a wearable base. Accordingly, an ornamental body can advantageously be attached to a hat or headband for the duration of a game, and the ornamental feature can be removed after the game.

In broad terms, the invention comprises an ornamental headgear fashion accessory for use as a selectively attachable and detachable ornamental body. A spring fastener, is used to connect the ornamental body to a hat, elastic headband, or other wearable base configured to be worn on a person's head.

In preferred embodiments the spring fastener is a hairpin with two prongs. One prong is received within a corresponding loop sewn into the ornamental body, and another prong passes through the ventilation hole of a baseball cap to secure the ornamental body to the cap. The ornamental body preferably forms an indicia representative of a team mascot or team affiliation, such as the horns of an animal mascot or a rendering of a fanciful mascot.

BRIEF DESCRIPTION OF THE DRAWINGS

FIG. 1 depicts a first embodiment of the invention including a hat having a pair of ornamental horns selectively attached with the use of a spring fastener;

FIG. 2 depicts the hat of FIG. 1 with the ornamental horns selectively removed with one horn being positioned for reattachment;

DETAILED DESCRIPTION OF THE PREFERRED EMBODIMENT

Figure 3:
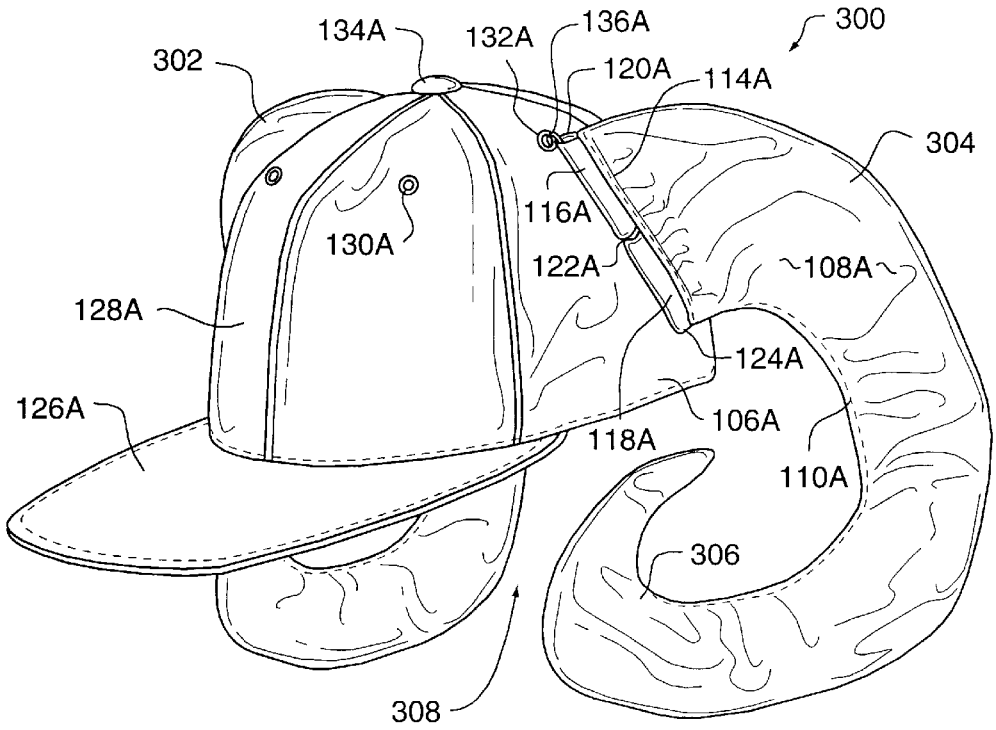
FIG. 3 depicts a second embodiment of the invention including a hat having a pair of ornamental horns selectively attached with the use of a spring fastener.

FIG. 1 depicts an ornamental hat 100 including a pair of ornamental horns 102 and 104 mounted on a baseball cap 106, which comprises wearable base for mounting the horns 102 and 104. The horns 102 and 104 are mirror images with respect to one another.

Horn 104 has an outer fabric shell 108, which is sewn along seam 110 to provide the appearance of a buffalo horn. As depicted in FIG. 1, a portion of shell 108 has been removed to reveal an interior that is filled with compressed cotton or synthetic batting 112 to increase the rigidity of shell 108. A second seam 114 is sewn to seal batting 112 within shell 108 and to form a pair of loops 116 and 118. Loop 116 proceeds parallel to second seam 114 with an interior space running within loop 116 from opening 120 to opening 122. Loop 118 is similarly constructed with a hollow opening 124.

Baseball cap 106 is a conventional cap containing a flexible bill 126 sewn to a fabric cup 128 that is adapted to be placed over a wearer's head. A plurality of grommets or ventilation holes, e.g. grommets 130 and 132, are spaced equidistantly around the upper perimeter of cup 128. A button 134 forms an apex on cap 106. A hairpin 136 passes into loop 116 and loop 118, as well as through hole 132, to function as a spring fastener in securing horn 104 to baseball cap 106. Horn 102 is attached to baseball cap 106 in an identical manner.

FIG. 2 depicts additional detail with respect to the manner of attaching horn 104 to baseball cap 106. As depicted in FIG. 2, horns 102 and 104 have been removed from baseball cap 106. Horn 104 is being placed in position for selective attachment to baseball cap 106, with prong 200 about to enter loop 116 and prong 202 about to enter hole 132.

Ornamental hat 100 can be worn with horns 102 and 104 attached while the wearer attends a sporting event, such as a university baseball, football, or basketball game. In the FIG. 1 embodiment, the horns identify the wearer as a fan of the University of Colorado Buffalos when the cap 106 as well as horns 102 and 104 have the black and gold colors that are the University colors. The horns 102 and 104 can be removed, as shown in FIG. 2, in order to permit use of cap 106 without frivolous ornamental horns. For example, cap 106 can be worn in the configuration shown in FIG. 2 for a night out on the town after the Buffalos have won a game while visiting another university. The detachable nature of horns 102 and 104 is advantageous if the wearer wishes to bring only one cap and fears that the presence of outlandish horns might spark physical reprisals if hat 100 is worn in various business establishments proximate the opposing university.

FIG. 3 depicts a second embodiment of the invention, namely, ornamental hat 300. In FIG. 3, identical numbering has been retained where possible with respect to FIG. 1, except a subscript "a" has been added to denote the second embodiment of ornamental hat 300. Ornamental hat 300 is identical to ornamental hat 100, except horns 302 and 304 are shaped differently than horns 102 and 104. Horns 302 and 304 are ram horns. Horns 302 and 304 may be colored green and gold for affiliation with the Colorado State University Rams. As represented by horn 304, a lower curl 306 extends forward in a direction substantially parallel to bill 126*a*. Curl 306 prevents pivoting of horn 304 by abutment against the wearer's head and neck situated in region 308 while hat 300 is being worn.

Figure 4:
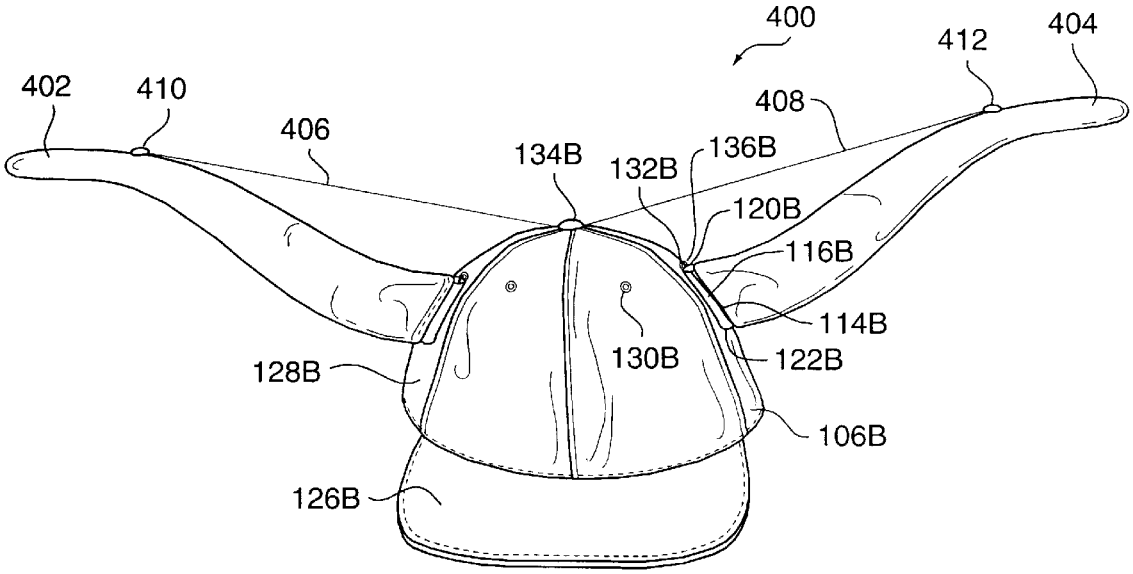
FIG. 4 depicts a third embodiment of the invention including a hat having a pair of ornamental horns selectively attached with the use of a spring fastener.

FIG. 4 depicts a third embodiment of the invention, namely, ornamental hat 400. In FIG. 4, identical numbering has been retained where possible with respect to FIG. 1, except a subscript "b" has been added to denote the third embodiment of ornamental hat 400. Ornamental hat 400 is identical to ornamental hat 100, except horns 402 and 404 are shaped differently than horns 102 and 104. Horns 402 and 404 are the horns of a longhorn, e.g., a University of Texas longhorn. A pair of guy wires 406 and 408 couple corresponding points of attachment 410 and 412 with button 134*b* to stabilize horns 402 and 404 against motion.

It will be appreciated that the ornamental horns 102, 104, 302, 304, and 402, 404 can be any ornamental feature including representations of pieces of cheese, bags for holding actual pieces of cheese, representations of watermelons, and representations of team mascots including stuffed heads of fanciful mascots or cartoon images. Similarly, the baseball caps 106, 106*a* and 106*b* are preferred, but other headgear can be similarly adapted for the receipt of a fastening means, e.g., a cowboy hat or headband can be retrofitted with a plurality of holes 132 for receipt of a spring fastener. The use of a hairpin, such as hairpin 136, 136*a*, and 136*b* for a spring fastener is preferred as a means for attaching the ornamental features because the use of a spring fastener does not require permanent modification of the headgear. Even so, other attachment means can be used including velcro, zippers, buttons, snaps, and hooks.

Those skilled in the art will understand that the preferred embodiments described above may be subjected to apparent modifications without departing from the true scope and spirit of the invention. The inventor, accordingly, hereby states her intention to rely upon the Doctrine of Equivalents, in order to protect her full rights in the invention.

1. Velcro is a registered trademark of Velcro Industries B.V. (Netherlands/Holland).

I claim:

1. A hat including an ornamental headgear fashion accessory for use as a selectively attachable and detachable ornamental body comprising a hat including a hole for receipt of a spring fastener;

an ornamental body including an opening for receipt of a spring fastener; and a spring fastener having a first prong for receipt within said hole and a second prong for receipt within said opening to secure said ornamental body on said hat.

* * * * *